United States Patent [19]

Brim

[11] Patent Number: 4,884,806

[45] Date of Patent: Dec. 5, 1989

[54] METHOD OF PLAYING A BOWLING GAME

[75] Inventor: Ted E. Brim, Grand Haven, Mich.

[73] Assignee: Brunswick Corporation, Skokie, Ill.

[21] Appl. No.: 162,147

[22] Filed: Feb. 29, 1988

[51] Int. Cl.[4] ..... A63D 3/00

[52] U.S. Cl. ..... 273/37

[58] Field of Search ..... 273/37, 51, 54 D; 434/249

[56] References Cited

U.S. PATENT DOCUMENTS

| | | | |
|---|---|---|---|
| 2,375,663 | 5/1945 | Kennedy | 273/54 DU X |
| 3,009,268 | 11/1961 | George | 273/54 DU X |
| 3,051,485 | 8/1962 | Heilbrun | 273/54 D |
| 3,076,652 | 2/1963 | Wolff | 273/54 D |
| 3,301,558 | 1/1967 | Clapham | 273/54 D X |
| 4,597,575 | 7/1986 | Kosof | 273/37 |

*Primary Examiner*—Anton O. Oechsle

*Attorney, Agent, or Firm*—Wood, Dalton, Phillips, Mason & Rowe

[57] ABSTRACT

A method of playing a bowling game in which players are allowed at least one ball to deliver during a turn of play. A given trajectory is selected for a ball to follow down a lane. A player is required to deliver at least one ball down the lane in an attempt to duplicate the given trajectory. The degree to which the player's delivered ball duplicates the given trajectory is determined. A score is awarded to the player which is a function of the degree to which the player's ball duplicated the given trajectory.

13 Claims, No Drawings

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. Strikes or spares are required to add a pin count for pins knocked down in subsequent frames to the pin counts of earlier frames. Obviously, the trajectory of a ball rolling down a lane determines its point of impacting a pin setup. The trajectory is determined by variables such as the point of initial layment of the ball onto the "boards", its direction of travel, as well as its speed, spin, velocity and resistance. Many bowlers have a particular trajectory which they attempt to duplicate in order to score a strike, for instance. In fact, experienced or expert bowlers can practically predict when a strike will be attained during early portions of a ball's trajectory down the lane. Some lanes have "hash marks", which may be termed rangefinders in the form of arrows marked on the lane boards themselves in a line across the lane approximately fifteen feet down the lane to assist bowlers in delivering a ball at a preferred lateral location early in the ball trajectory.

There is a definite need for new methods of playing a bowling game which are more exciting; for games which are challenging but not difficult; for games to increase and enhance the public interest in the sport; and, additionally as with the present invention, to assist in teaching and/or training bowlers in proper techniques. This invention is directed to satisfying these needs, enhancing interest in bowling games, teaching and training the art of proper ball trajectory for achieving optimum results, and to simply provide a new and fun bowling game.

SUMMARY OF THE INVENTION

An object of the invention, therefore, is to provide a new method of playing a bowling game in which players are allowed to deliver balls to knock down pins of a given pin setup during a turn of play and, additionally, awarding players for duplicating or closely duplicating given ball trajectories.

According to the inventive method, generally, a given trajectory is selected for a ball to follow down the lane. Each player of the game is required to deliver at least one ball down the lane in an attempt to duplicate the given trajectory. The degree to which the player's delivered ball duplicates the given trajectory is determined. A score is awarded to the player which is a function of the degree to which the player's ball duplicated the given trajectory. The scoring can be enhanced by adding the number of pins knocked down by the player, such as with a multiple, along with the player's degree of duplicating the given trajectory.

Conventional bowling lanes are fabricated with wooden, laminated boards extending lengthwise of the lane. Standard lanes include thirty-nine boards, crosswise, whereby the side boards can be numbered "one" toward the center board which can be numbered "twenty" (i.e., thirty-nine boards total). These longitudinally extending boards provide means by which variances from a given ball trajectory can be calculated. In other words, should a particular point in a given ball trajectory, at a given distance down the lane, be at the fifth board from the right, any ball passing that point at a lateral distance therefrom, could easily be calculated as being "X boards" from the trajectory path. This simple board calculation can be used to arrive at a scoring scheme for the game. It can be seen that a given ball trajectory, therefore, can be defined by multiple locating points spaced down the lane, and board variances from those points can easily be calculated.

Of course, any variety of scoring schemes, methods of calculating ball trajectory variances and ultimate game scoring systems can be derived based on the basic concept of the invention of requiring a bowler to deliver a ball down the lane in an attempt to duplicate a given ball trajectory.

Other objects, features and advantages of the invention will be apparent from the following detailed description.

DETAILED DESCRIPTION OF THE PREFERRED EMBODIMENT

According to the invention, a method of playing a bowling game generally comprises players being allowed at least one ball to deliver during a turn of play. The turn of play may be a conventional "frame" should pin setups be used during the scheme of play. A given trajectory is selected for a ball to follow down the lane. This ball trajectory can be arrived at in various manners. For instance, with a ten-pin setup, some bowlers believe that there is an optimum ball trajectory whereby, for a right-handed bowler, the ball should strike the pin setup at an angle somewhere between the "first" and "third" numbered pins of a conventional pin numbering system, i.e., at the forward apex of the triangular array of pins. On the other hand, any variety of other schemes can be contemplated, such as a plurality of ball trajectories be provided for selection by the players of the game. One player may select a trajectory and require his competitor or competitors to attempt to duplicate the trajectory. Different ball trajectories may be selected at random. Whatever the scheme, the game of this invention can be used either as a teaching tool or simply as a fun game or a combination of both.

Once a given ball trajectory is selected, each player of the game is required to deliver at least one ball down the lane in an attempt to duplicate the given trajectory. The degree to which the player's delivered ball duplicates the given trajectory is determined. This step of the method can be accomplished by any variety of procedures.

As described in the "Summary" portion above, variances from a given ball trajectory can be determined by using the width of the boards running lengthwise of a conventional bowling lane, and utilizing rangefinders, arrows or hash marks at specific lane locations spaced down the lane, with the rangefinders being spaced along a line extending transversely across the lane. In fact, the boards can be numbered on an appropriate chart since a conventional lane has 39 boards. The boards can be numbered "1" for each of the two outside boards and increasing in number to the center board which can be numbered "20" (i.e. 39 boards).

For example, assume that there are three lateral series of rangefinders spaced 15, 30 and 45 feet, respectively, down the lane. A bowler may deliver a ball and it be determined that the ball was located at "12 board" at 15 feet, "13 board" at 30 feet and "15 board" at 45 feet down the lane. These ball locations, in essence, define the trajectory of the delivered ball. If the locations are at a variance from the locations of a selected or given trajectory, the "board distances" (which actually define lateral spacing) can be used to score the game. In fact, should a bowler be given the lane location information described above, after a "good strike" is delivered, the bowler can use that ball trajectory in attempts to duplicate it with each delivery. This being still another scheme for playing the game.

The manner in determining the degree to which a player's delivered ball duplicates a given trajectory also can vary from a very basic procedure of "eyeballing" the ball as it passes the various series of rangefinders. Of course, this somewhat crude manner could best be done by other players of the game rather than the player delivering the ball who is usually preoccupied with his delivery. Such manual means as placing a narrow strip of tracing paper adjacent each series of rangefinders which would leave a small mark on the lane as a ball passes thereover could be used. Fine powder also could be used whereby a ball would leave a track which easily can determine the "board" over which the ball passed. Either such means could be used to determine precise dimensions away from a given trajectory path, rather than even using the numerical "board" calculation method.

Still further, sophisticated digital readout or computerized systems can be used to determine the delivered ball's trajectory. For instance, a ball trajectory unit or tracker may be capable of measuring the position of a bowling ball at various positions down the lane, such as eight different and distinct lane locations. Such a mechanism or unit is disclosed in copending application Ser. No. 182,977, filed Apr. 18, 1988, and which is incorporated herein by reference. Such sophisticated equipment, in fact, can display information on a screen, if desirable.

Whether using any of the basic, crude or sophisticated methods of determining a delivered ball's trajectory, as described above, the degree to which a player's delivered ball duplicates a given trajectory can be determined. Therefore, a score can be awarded to the player which is a function of the degree to which the player's ball duplicated the given trajectory. This score can be recorded and used for training or teaching purposes. The score also can be recorded and compared with other players' scores during the course of a fun and competitive game.

In addition, pin setups can be used to add to a scoring scheme, such as being a multiplying factor in addition to the ball trajectory variances.

Still further, as is known, bowlers can be given handicaps as determined by their experience and/or skill of play.

The following is an example of a scheme of play and scoring employing the concepts of the invention. Each player's score is based on (1) how close the player comes to "hitting their target" (i.e. how close the ball comes to a rangefinder or target which defines the ball trajectory as described above), and (2) how many pins the player knocks down during each ball delivery. A method of handicapping each player according to his or her ability also is included in the score. Each player thereby is awarded a score depending upon how close the player comes to the ball trajectory and also upon their bowling ability.

| Distance From Rangefinder | AVERAGE | | | |
|---|---|---|---|---|
| | Below 150 | 150–169 | 170–189 | 190 and above |
| 0 to 1 board inclusive | 20 | 16 | 12 | 10 |
| 1 to 2 boards inclusive | 18 | 14 | 10 | 8 |
| 2 to 3 boards inclusive | 16 | 12 | 8 | 6 |
| 3 to 4 boards inclusive | 14 | 10 | 6 | 4 |
| 4 to 5 boards inclusive | 12 | 8 | 4 | 3 |
| 5 to 6 boards inclusive | 10 | 6 | 3 | 2 |
| 6 to 7 boards inclusive | 8 | 4 | 2 | 1 |

With the above scoring scheme, assume that a bowler with a 162 average misses a given rangefinder along a given ball trajectory by three boards, that player will receive a score of 12. If a bowler with a 177 average misses the rangefinder by 1.5 boards, the player will receive a score of 10. If a bowler with a 133 average misses the rangefinder by only one board, the player will receive a score of 20. Of course, as described above, multiple series of rangefinders may be located at spaced locations down the lane, and the same scoring scheme could be used for a full ball trajectory. This is but one scoring scheme which may be employed using the concepts of the invention.

From the foregoing, it can be seen that a new method of playing a bowling game has been provided. The method can be used to teach and train bowlers in the significance of ball trajectory, as well as in an entire scheme of play to provide a fun and competitive game. The method can use pin setups, can use handicapping or bowling averages, and can provide varying schemes of play as described above. The method certainly can enhance the interest of bowlers in comparison to conventional bowling games where strikes and spares and the accompanying complicated scoring system can often lead to frustration and lack of interest.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein

I claim:

1. A method of playing a bowling game in which players are allowed at least one ball to deliver during a turn of play, said method comprising:

providing a pin setup for each turn of play;

selecting a given trajectory for a ball to follow down a lane;

requiring a player to deliver at least one ball down the lane in an attempt to duplicate said given trajectory and to attempt to knock down pins while following the given trajectory;

determining the degree to which the player's delivered ball duplicates the given trajectory up to the point that the ball reaches the pin setup; and awarding a score to the player which is at least partially a function of the degree to which the player's ball duplicated the given trajectory independent of the number of pins knocked down.

2. The method of claim 1 wherein said score is determined as a function of the degree to which the player's ball duplicated the given trajectory and the number of pins knocked down by the player.

3. The method of claim 1 wherein the degree to which the player's delivered ball duplicates the given trajectory is determined by distance variances from the trajectory path.

4. The method of claim 3 wherein said variances are calculated by the number of lane boards the delivered ball is away from the trajectory path.

5. The method of claim 1 wherein the degree to which the player's ball duplicates the given trajectory is determined by the lateral distance the ball is away from a designated point located down the lane on the given trajectory path.

6. The method of claim 5 wherein said lateral distance is calculated by the number of lane boards the delivered ball is away from the trajectory path.

7. The method of claim 5 wherein a plurality of said designated points are located at spaced locations down the lane on the given trajectory path.

8. A method of playing a bowling game in which players are allowed at least one ball to deliver during a turn of play, said method comprising:

providing a pin setup for each turn of play;

selecting a given trajectory for a ball to follow down a lane by means of a series of rangefinder markings spaced laterally of the lane at a given point down the lane;

requiring a player to deliver at least one ball down the lane in an attempt to duplicate said given trajectory and to attempt to knock down pins while following the given trajectory;

determining the degree to which the player's delivered ball duplicates the given trajectory up to the point that the ball reaches the pin setup by determining the distance the delivered ball is away from a designated one of said rangefinder markings; and awarding a score to the player which is at least partially a function of the degree to which the player's ball duplicated the given trajectory independent of the number of pins knocked down.

9. The method of claim 8 wherein said distance from the one rangefinder marking is calculated by the number of lane boards the delivered ball is away from the one rangefinder marking.

10. The method of claim 8 wherein said given trajectory is defined by one of said series of rangefinder markings.

11. The method of claim 8, including a plurality of said series of rangefinder markings spaced at given locations down the lane.

12. The method of claim 11 wherein said given ball trajectory is determined by one of the rangefinder markings in each of said series thereof.

13. The method of claim 8 wherein said score is determined as a function of the degree to which the player's ball duplicated the given trajectory and the number of pins knocked down by the player.

* * * * *